United States Patent [19]

Shiurila et al.

[11] Patent Number: 4,491,433

[45] Date of Patent: Jan. 1, 1985

[54] VENTING AND INK RECYCLING DEVICE

[75] Inventors: John Shiurila, Londonderry; Kenneth A. Robert, Derry, both of N.H.

[73] Assignee: Centronics Data Computer Corp., Hudson, N.H.

[21] Appl. No.: 527,234

[22] Filed: Aug. 29, 1983

[51] Int. Cl.[3] ..... B41J 27/02

[52] U.S. Cl. ..... 400/471.1; 101/364; 118/612; 346/140 R; 248/128

[58] Field of Search ..... 400/470, 471, 471.1; 101/210, 364, 365; 55/36, 87, 178; 159/DIG. 4; 118/600, 612; 137/170.1–170.6; 209/169; 222/190; 239/121, 124; 248/128, 133, 144, 145; 261/DIG. 10, DIG. 26, DIG. 44; 346/140 R, 140 PD, 140 IJ; 401/15

[56] References Cited

U.S. PATENT DOCUMENTS

| | | | |
|---|---|---|---|
| 3,120,804 | 2/1964 | Besewick | 101/364 |
| 3,212,916 | 10/1965 | Metcalfe et al. | 118/612 |
| 3,520,822 | 7/1970 | Traelnes | 55/178 |
| 3,679,600 | 7/1972 | Hahm | 55/178 |
| 4,004,302 | 1/1977 | Hori | 261/DIG. 26 |
| 4,230,467 | 10/1980 | Buchwald et al. | 55/178 |
| 4,301,459 | 11/1981 | Isayama et al. | 346/140 R |
| 4,400,102 | 8/1983 | Shiurila et al. | 400/471.1 |

FOREIGN PATENT DOCUMENTS

| | | | |
|---|---|---|---|
| 8002533 | 11/1980 | European Pat. Off. | 101/364 |
| 2547608 | 4/1977 | Fed. Rep. of Germany | 346/140 R |
| 2222 | of 1873 | United Kingdom | 248/128 |

*Primary Examiner*—Paul T. Sewell
*Assistant Examiner*—David A. Wiecking
*Attorney, Agent, or Firm*—Kenway & Jenney

[57] ABSTRACT

The ink supply container disclosed herein is adapted for use with a moving carriage printer and controls foaming of a liquid ink in the container by providing, at the top of the container, a well having a sloping floor. Foamed ink is communicated to the well where it is condensed and returns through an opening at the lower end of the floor.

25 Claims, 5 Drawing Figures

VENTING AND INK RECYCLING DEVICE

FIELD OF THE INVENTION

The present invention relates to improvements in ink supply to high speed reciprocating print mechanisms. More particularly, the invention relates to a novel technique for recycling liquid and foaming ink expelled from an ink reservoir supplying ink to a high-speed printer.

BACKGROUND OF THE INVENTION

Most high-speed printers presently in use employ ink as the printing means. Since the use of inked ribbons has substantial drawbacks, the process of applying liquid ink directly at the interface between the printing device and the print media has become more common. This method preferably uses an ink reservoir with a substantial capacity so as to extend the interval between either the replacement of the ink supply container or the refilling of the reservoir. In such ribbonless print mechanisms, ink is delivered from the reservoir to print wires through a "wick" which utilizes the principles of capillary action. Devices utilizing such ink reservoirs are shown in U.S. Pat. No. 4,353,654 and U.S. Pat. No. 4,400,102, both of which are assigned to the assignee of the present invention.

The reservoir is typically mechanically attached to the print mechanism and therefore any movement of the underlying carriage causes the ink to slosh within the reservoir resulting in leakage through any vent(s) that may be present. The movement principally responsible for causing the sloshing of the ink is the reciprocating movement of the carriage which occurs while the apparatus is printing. The movement also causes bubbles to form at the surface of the ink, and with the movement accompanying the printing mechanism, bubbles foam up through reservoir vent(s), particularly when there is a substantial amount of ink still in the reservoir. Elimination of the vents will not solve the problem because the vents are necessary for the proper flow of ink from the reservoir to the printing device. The resulting loss of ink also impedes removal of the reservoir because with ink covering the reservoir, it is difficult to securely grasp the reservoir. As a result, refilling or replacing the ink supply becomes a messy and time-consuming operation.

The prior art has attempted to deal with the ink sloshing problems by employing baffles within the ink reservoir to minimize the loss of both liquid and foaming ink. These baffles attempt to minimize the movement of the ink within the reservoir. By minimizing the ink's movement it is hoped that less sloshing and foaming of the ink will occur. These baffles, however, have not proven to be 100% effective in preventing sloshing or foaming of the ink and loss of ink still occurs. Additionally, this problem has been addressed by not completely filling the ink reservoir, but this fails to make maximum use of the container volume thereby necessitating more frequent replacement or refilling.

A principal object of the present invention is to permit a liquid ink mechanism to be used in conjunction with a reciprocating printer mechanism without loss of liquid or foaming ink through a vent hole.

Another object of the present invention is to permit the ink reservior to be filled to its maximum level without loss of ink due to reciprocating motion of the printing mechanism thereby permitting maximum intervals to elapse between refills.

A further object of the present invention is to keep the ink reservoir clean for ease of handling during reloading and refilling operations.

SUMMARY OF THE INVENTION

The present invention permits complete filling of the ink reservoir thereby utilizing the maximum cubic area of the container volume and at the same time avoids expulsion of ink in either liquid or foam form by recirculating the expelled ink back into the reservoir thereby avoiding the mess and loss of ink associated with prior art ink reservoirs. The invention employs a well mounted atop the reservoir containing a "teardrop" opening with a sloping floor and two tapered tubes extending from the well to the reservoir. The first, a capillary tube, running from a point midway along the floor of the "teardrop" opening to the top of the reservoir serves as a conduit for either liquid or foaming ink which is expelled from the reservoir due to the reciprocating motion of the printing mechanism to which the reservoir is attached. The "teardrop" opening slopes towards a second, recirculating, tube extending from the floor of the well some three-quarters of the distance to the ink reservoir bottom.

The unique "teardrop" opening in conjunction with the tapered tubes prevents liquid or foaming ink migration upwards to the small vent hole in the top of the well and encourages ink, in foam form, to liquify and drop back into the reservoir via the recirculating tube. Liquid ink flows along the slanted floor of the well under gravity from the capillary tube to the recirculating tube and into the ink reservoir. The vent above the well is formed by puncturing a thin sealing membrane just prior to the use of the reservoir on the printing mechanism.

The improved venting and ink recycling mechanism is preferably used in conjunction with baffles located within the reservoir providing attenuation of ink movement due to the reciprocating motion of the printing mechanism.

These and other features and objects of the present invention will be more fully understood from the following detailed description which should be read in light of the accompanying drawings.

BRIEF DESCRIPTION OF THE DRAWINGS

Corresponding reference characters represent corresponding parts throughout the several views of the drawings.

DETAILED DESCRIPTION OF THE PREFERRED EMBODIMENT

Figure 1:
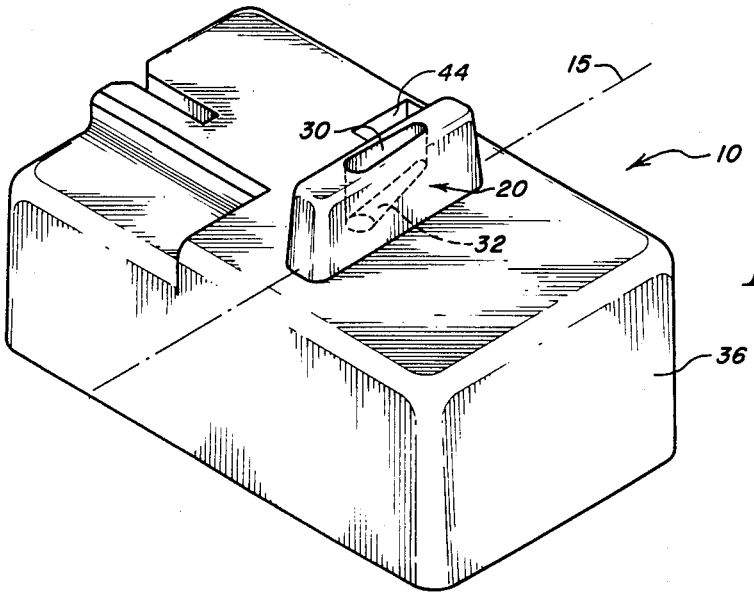
FIG. 1 is a perspective view of an ink supply container employing the improved recirculating vent mechanism.

The improved recirculating vent mechanism of the present invention is shown in FIG. 1 mounted on ink container 10. In the preferred embodiment, the combination vent and recirculating apparatus is deployed above ink reservoir 36 in raised rectangular portion 20 integral with container 10. The raised rectangular portion is oriented along an axis 15 perpendicular to the motion of the underlying print mechanism on which ink container 10 is mounted. Raised portion 20 contains well 30 with sloping bottom floor 32 whose slope is oriented along the direction of axis 15. The ink reservoir also contains an opening 44 which receives the wick (not shown) which delivers ink from the reservoir 36.

Figure 2:
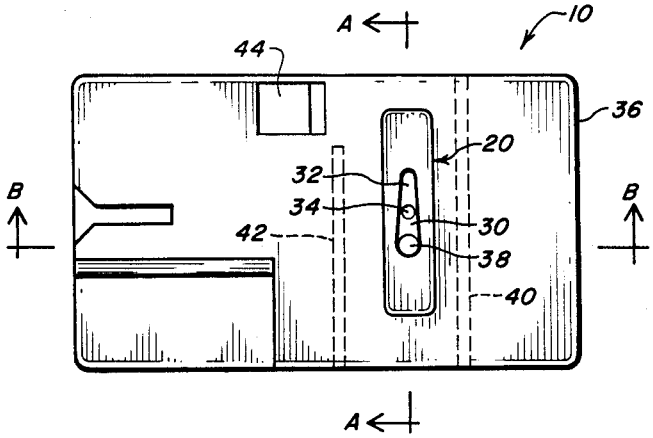
FIG. 2 is a top plan view of the container of FIG. 1.
Figure 3:
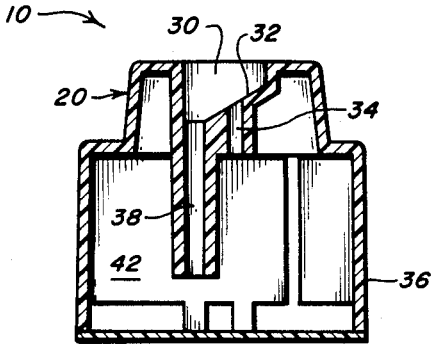
FIG. 3 is a cross-sectional view of the container of FIG. 2 along line A—A.

Referring to FIGS. 2 and 3, there is shown a capillary tube 34 which is integral with container 10 and which runs from the top of the ink reservoir 36 to the well floor 32. Capillary tube 34 is preferably located midway within the well as measured along axis 15. Also integral with container 10 is recirculating tube 38 located at the lowest portion of well 30 and extending into reservoir 36, preferably three-quarters of the way to the bottom. Well 30 is, in plan, of "teardrop" shape: being larger at the down-slope end where recirculating tube 38 terminates in well 30 than at the up-slope end.

Figure 4:
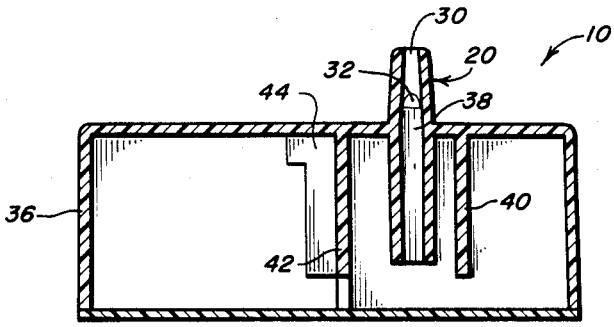
FIG. 4 is a cross-sectional view of the container of FIG. 2 along line B—B.

In the preferred embodiment, as shown in FIG. 4, recirculating tube 38 is surrounded by baffles 40 and 42 located within reservoir 36 to minimize the loss of ink either through outright expulsion of liquid ink up through tubes 34 or 38 or through the loss of foaming ink formed through the sloshing motion and migrating upward through tubes 34 or 38. Tube 38 extends three-quarters of the way into reservoir 36 so as to minimize the loss of liquid ink from sloshing and through the migration of foaming ink. Once the ink volume in the container decreases, through its use, none of the sloshing nor bubble formation problem is of concern and thus tube 38 need only extend part way down into reservoir 36.

In one embodiment, floor 32 slopes at approximately 30 to 31 degrees from the horizontal. Capillary tube 34 is preferably tapered at one-half degree to the horizontal with an upper diameter of 0.094 inches at its terminus on well floor 32 and of slightly larger diameter at its lower end. These diameters are specifically chosen to facilitate the capillary movement of foam ink to the floor of well 30, and to encourage the condensation of liquid ink from the foam. The taper is specifically designed to discourage the rise of liquid ink through tube 34. The taper of tubes 34 and 38 also serves to encourage liquid ink to migrate downward and drain out the bottoms of these tubes as well as serving to discourage the upward migration of foamed ink within the tubes. Recirculating tube 38 is also preferably tapered and of approximately 0.125 inches in diameter at its terminus on well floor 32 and of diameter 0.150 inch at its lower end.

In the preferred embodiment, capillary tube 34 has upper diameter equal to the width of teardrop well 30 at the point at which it terminates on floor 32, thereby encouraging the formation of droplets from ink bubbles drawn by capillary action up tube 34 and enhancing the flow of the resulting liquid ink back to recirculating tube 38 and into reservoir 36. Similarly, the upper diameter of tube 38 equals the width of teardrop well 30 at the point where it terminates on well floor 32. Well 30 at its down-slope end is formed of a semicircular surface of diameter equal to the upper diameter of tube 38 thereby encouraging liquid ink collected in well 30 to drain through tube 38.

In operation, a filled ink container of the present invention is placed in its appropriate location in the printer. The ink in the filled container 10 will occupy nearly the entire volume of reservoir 36 and extend virtually to the top of ink reservoir 36. As the printing mechanism reciprocates in its travel, the ink will slosh about and may be forced in liquid form up through either tube 34 or 38 to well floor 32. Due to the slope of well floor 32, such liquid ink will tend to flow back through tube 34 or 38 into reservoir 36 without escaping to the exterior of container 10. Ink in foam form as produced by the reciprocating motion of the print mechanism will tend to rise through capillary tube 34, due to its specially selected diameter and to the fact that it is open to reservoir 36, and will be delivered to the floor of well 30. Due to the teardrop shape and the slope of floor 32, ink foam will tend to liquify and return through recirculating tube 38 under the motion of the mechanism on which container 10 is mounted.

Recirculating tube 38 is surrounded by baffles 40 and 42, arrayed along axis 15, i.e. perpendicular to the direction of motion of container 10, and the lower end of tube 38 is below ink level when reservoir 36 is more than one-quarter full. The lower end of tube 38 is therefore exposed to only a small proportion of the amount of sloshing and splashing ink that is otherwise present in reservoir 36. In addition, this remaining ink is not as agitated as ink in a filled bottle due to the attenuation provided by baffles 40 and 42. Furthermore, during the time that the ink level is above the lower end of tube 38, only the amount of ink immediately within tube 38 is capable of producing liquid or foam ink which can be expelled upward through tube 38. Once the level of ink is below the lower end of tube 38, only approximately one-fourth of the original quantity of ink remains in reservoir 36 and the propensity for any ink foam or liquid ink to be expelled is markedly lowered.

Figure 5:
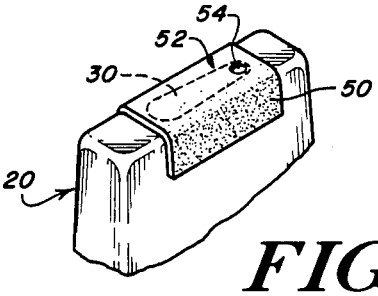
FIG. 5 is a perspective view of the sealing membrane with vent hole.

As shown in FIG. 5, although omitted from the other figures for clarity, raised portion 20 is preferably outfitted with an adhesive membrane 50 which seals container 10 after manufacture and filling. Once container 10 is attached to the printing mechanism, seal 50 is punctured, preferably at location 52, to create a vent hole 54 near the up-slope vertex of the teardrop opening. Seal 50 remains on container 10 for the life of the ink supply.

When reservoir 36 is full, the tube 38 is also full. The tube 34 is a vent for the well 30. When the ink bubbles come through the tube 34 into well 30, during the operation of the carriage, the ink from tube 38 splashes into well 30 and liquifies the foam (bubbles) and sends it back to the reservoir (container) 36, through tube 38. The seal tab 50 is, of course, punctured when container is placed into operation. This cycle continues over and over until the ink level is depleted to such height where the subject venting is no longer effective.

In view of the foregoing, it may be seen that several objects of the present invention are achieved and other advantageous results have been attained.

As various changes could be made in the above constructions without departing from the scope of the invention, it should be understood that all matter contained in the above description or shown in the accompanying drawings shall be interpreted as illustrative and not in a limiting sense.

What is claimed is:

1. In an ink supply container adapted to be mounted upon a moving carriage for use in supplying liquid ink to a printing member, said container including an ink reservoir, the improvement comprising:

a well positioned above said reservoir including a top portion containing a venting orifice and a sloping floor portion, said well capturing ink which is expelled from said reservoir;

capillary means for conveying said expelled flow of liquid or foam ink to said well; and means for recirculating said collected and condensed ink from said well to said reservoir, whereby said well condenses and collects said expelled liquid or foam ink and returns said ink to said reservoir.

2. Apparatus according to claim 1 wherein said capillary means is an elongated tubular member having a first end terminating at said ink reservoir and a second end terminating at said sloping floor portion, and wherein said recirculating means is an elongated tubular member having a first end extending into said ink reservoir and a second end terminating at said sloping floor portion positioned down-slope from said capillary member terminus.

3. Apparatus according to claim 2 wherein said well floor portion slopes in a direction transverse to said direction of movement.

4. Apparatus according to claim 1 wherein said well further comprises:

two substantially identical sidewall portions extending substantially along said sloping direction, a substantially concave third sidewall portion which together with said identical sidewall portion, forms a substantially U-shaped vertex located at the up-slope end of said well, and a substantially concave fourth sidewall portion which together with said identical sidewall portions forms a substantially U-shaped vertex located at the down-slope end of said well, wherein said sidewall portions cooperate with said sloping floor to urge said expelled liquid and foam ink toward said recirculating means.

5. Apparatus according to claim 2 wherein said well further comprises:

two substantially identical sidewall portions extending substantially along said sloping direction, a substantially concave third sidewall portion which together with said identical sidewall portion, forms a substantially U-shaped vertex located at the up-slope end of said well, and a substantially concave fourth sidewall portion which together with said identical sidewall portions forms a substantially U-shaped vertex located at the down-slope end of said well, wherein said sidewall portions cooperate with said sloping floor to urge said expelled liquid and foam ink toward said recirculating means.

6. Apparatus according to claim 4 wherein said venting orifice is adjacent said up-slope vertex.

7. Apparatus according to claim 1 wherein said sloping floor portion makes an angle of approximately 30° to 31° with the horizontal.

8. Apparatus according to claim 5 wherein said elongated capillary member is positioned with its axis substantially vertical with the cross-sectional diameter of said first end being slightly greater than the cross-sectional diameter of said second end, thereby discouraging upward migration of said expelled liquid ink and encouraging the liquification of said expelled ink foam.

9. Apparatus according to claim 2 wherein said elongated recirculating member is positioned with its axis substantially vertical with the cross-sectional diameter at said first end greater than the cross-sectional diameter at said second end; thereby discouraging upward migration of said expelled liquid ink and encouraging the liquification of said expelled ink foam.

10. Apparatus according to claim 2 wherein said first end of said recirculating member extends into said reservoir approximately three-quarters of the distance below the surface of ink when said reservoir is full, thereby limiting the area of liquid ink in said reservoir to which said recirculating member is exposed and discouraging the formation of ink foam within said member and discouraging the expulsion of liquid ink through said member.

11. Apparatus according to claim 8 wherein said concave fourth sidewall portion is substantially circular with an inner radius approximately equal to that of said second end of said recirculating member and concentrically aligned with said member so that said substantially circular concave surface of said fourth sidewall forms a smooth extension of said recirculating member, thereby urging said collected and condensed ink down said recirculating member.

12. Apparatus according to claim 5 wherein said well identical sidewall portions are plane surfaces located tangentially to the ellipse formed at the terminus of the second end of said capillary member and said sloping wall floor, thereby urging said expelled liquid and foam ink toward said recirculating member and encouraging said collection and condensation of said expelled liquid or foam ink.

13. Apparatus according to claim 1 wherein a thin membrane covers the top portion of said well.

14. Apparatus according to claim 12 wherein said venting orifice is formed by puncturing said membrane.

15. Apparatus according to claim 1 further comprising a plurality of baffles being integrally joined to the interior surface of said reservoir and extending into said ink in said reservoir for attenuating sloshing and splashing of said ink due to said reciprocating movement of said container during printing.

16. Apparatus according to claim 5 further comprising a plurality of baffles being integrally joined to the interior surface of said reservoir and extending into said ink in said reservoir for attenuating sloshing and splashing of said ink due to said reciprocating movement of said container during printing.

17. Apparatus according to claim 16 wherein said baffles comprise thin elongated members having a width many times greater than its thickness forming opposed major surfaces arranged transverse to the direction of movement of said container, wherein said plurality of baffles are disposed within said reservoir in proximity to said recirculating member so that together with certain of said sidewall portions arrayed substantially parallel to said direction of movement of said container, a substantially rectangular porous subvolume is formed within said reservoir into which said first end of said elongated tubular recirculating extends thereby permitting said subvolume to readily communicate fluid with said reservoir in steady-state but impeding transient communication of fluid therebetween.

18. Well means adapted for use in conjunction with an ink reservoir mounted on a moving printing member and supplying liquid ink to same for condensing, collecting and recycling liquid or foam ink expelled from said reservoir comprising:

a top portion containing a venting orifice, a sloping floor portion, inlet means for conveying said expelled liquid or foam ink to said well floor, outlet means for recycling said condensed and collected ink to said reservoir, and a plurality of sidewall portions forming a "teardrop" in cross-sectional shape, whereby said venting orifice, said sloping floor and said sidewall portions cooperate to condense and collect said liquid or foam ink on said sloping floor for conveyance by gravity flow to said outlet for return to said reservoir.

19. Apparatus according to claim 18 wherein said inlet means is an orifice in said sloping floor portion, and wherein said outlet means is an orifice in said sloping floor portion positioned down-slope from said inlet to receive said condensed and collected liquid or foam-ink.

20. Apparatus according to claim 19 wherein said well floor portion slopes in a direction transverse to said direction of said movement of said carriage and wherein said well sidewall portions include:

two substantially identical sidewall portions extending substantially along said sloping direction, a substantially concave third sidewall portion which together with said identical sidewall portion, forms a substantially U-shaped vertex located at the up-slope end of said well, and a substantially concave fourth sidewall portion which together with said identical sidewall portions forms a substantially U-shaped vertex located at the down-slope end of said well, wherein said sidewall portions cooperate with said sloping floor to urge said expelled liquid and foam ink toward said outlet.

21. Apparatus according to claim 19 wherein said venting orifice is adjacent said up-slope vertex.

22. Apparatus according to claim 20 wherein said outlet orifice is substantially circular in plan and wherein said concave fourth sidewall portion is substantially circular with an inner radius nominally equal to that of said outlet orifice and concentrically aligned with same so that said substantially circular concave surface of said fourth sidewall forms a smooth extension of said outlet, thereby urging said collected and condensed ink down said outlet orifice.

23. Apparatus according to claim 20 wherein said inlet orifice is substantially circular in plan and wherein said well identical sidewall portions are plane surfaces tangent to said inlet orifice; thereby urging said expelled liquid and foam ink toward said outlet orifice and encouraging said collection and condensation of said expelled liquid or foam ink.

24. Apparatus according to claim 18 wherein a section of said top portion of said well is covered by a thin membrane.

25. Apparatus according to claim 24 wherein said venting orifice is formed by puncturing said membrane.

* * * * *